US005449500A

United States Patent [19]

Zettel

[11] Patent Number: 5,449,500

[45] Date of Patent: Sep. 12, 1995

[54] BARRIER STRIP FOR A SUPPORT MAT IN A CATALYTIC CONVERTER

[75] Inventor: Steven Zettel, Cranston, R.I.

[73] Assignee: ACS Industries, Inc., Woonsocket, R.I.

[21] Appl. No.: 275,298

[22] Filed: Jul. 14, 1994

[51] Int. Cl.[6] ..... B01D 53/88; B01D 53/94

[52] U.S. Cl. ..... 422/179; 55/502

[58] Field of Search ..... 422/177, 179, 180, 211, 422/221, 222, 240; 55/495, 500, 502, DIG. 30; 502/527; 428/605, 609

[56] References Cited

U.S. PATENT DOCUMENTS

| | | | |
|---|---|---|---|
| 4,116,389 | 9/1978 | Furtah et al. | 239/132.5 |
| 4,344,922 | 8/1982 | Santiago et al. | 422/179 |
| 4,683,010 | 7/1987 | Hartmann | 148/287 |
| 4,951,954 | 8/1990 | MacNeill | 277/230 |
| 5,008,086 | 4/1991 | Merry | 422/179 X |
| 5,207,989 | 5/1993 | MacNeil | 422/179 |

*Primary Examiner*—Robert J. Warden
*Assistant Examiner*—Robert Carpenter
*Attorney, Agent, or Firm*—Salter & Michaelson

[57] ABSTRACT

A catalytic converter apparatus includes a housing having a chamber, an inlet for receiving gas, and an outlet for exhausting gas. The apparatus further includes a catalytic brick positioned within the chamber for purifying the gas and a support mat disposed between the housing and the brick for supporting the brick with respect to the housing. The support mat has a leading edge located adjacent the inlet of the housing. The improvement includes a barrier strip attached to the leading edge of the support mat for protecting the leading edge from excessive wear resulting from the flow of gas over the leading edge of the mat.

8 Claims, 3 Drawing Sheets

BARRIER STRIP FOR A SUPPORT MAT IN A CATALYTIC CONVERTER

SUMMARY OF THE INVENTION

This invention relates generally to catalyst apparatus and more particularly to a catalytic converter including a catalyst brick support mat having a barrier strip for protecting a leading edge of the support mat.

In a catalytic converter, support mats secure and position a catalytic brick within a chamber of the catalytic converter housing. The support mat is made from intumescent material, such as material sold under the tradename "INTERAM" by 3M of Minneapolis, Minn., and is designed to occupy the space within the chamber between the brick and the interior wall of the housing. A problem with prior support mats is that a leading edge of the mat (i.e., the edge of the mat adjacent to an inlet of the housing) is subject to excessive wear caused by the flow of hot gas over the leading edge of the mat. The wear on the leading edge progresses rather rapidly until the support mat fails to support the brick within the housing. Without proper support, the brick can cause extensive damage to the housing thereby causing the catalytic converter to cease performing its function (i.e., purifying gas produced by the engine of the automobile).

Heat resistant gaskets, separate from the support mat and applied over the leading edge of the brick, provide some level of protection to the leading edge of the support mat. However, this gasket is subject to failure and may cause damage to the support mat.

Among the several objects of the present invention is the provision of a catalytic brick support mat having a barrier strip positioned at its leading edge which is resistant to excessive wear caused by the flow of hot gas over the mat; the provision such a barrier strip which is resistant to compressive forces exerted by the support mat and brick on the barrier strip; the provision of such a barrier strip which does not decompose when exposed to hot gas; the provision of such a barrier strip which substantially prevents hot gas from contacting the support mat; and the provision of such a barrier strip which is easy to construct and attach to the support mat, and cost efficient to manufacture.

In general, the invention is directed to a catalytic converter apparatus of the type comprising a housing having a chamber, an inlet for receiving gas, and an outlet for exhausting gas. The apparatus further comprises a catalytic brick positioned within the chamber for purifying gas entering the chamber via the inlet and a support mat disposed between the housing and the catalytic brick for supporting the catalytic brick with respect to the housing. The support mat has a leading edge located adjacent the inlet of the housing. The improvement comprises a barrier strip attached to the leading edge of the support mat for protecting the leading edge from excessive wear resulting from the flow of hot gases over the leading edge of the mat.

Other objects, features and advantages of the invention shall become apparent as the description thereof proceeds when considered in connection with the accompanying illustrative drawings.

BRIEF DESCRIPTION OF THE DRAWINGS

Corresponding references designate corresponding parts throughout the several views of the drawings.

DETAILED DESCRIPTION OF THE PREFERRED EMBODIMENT

Figure 1:
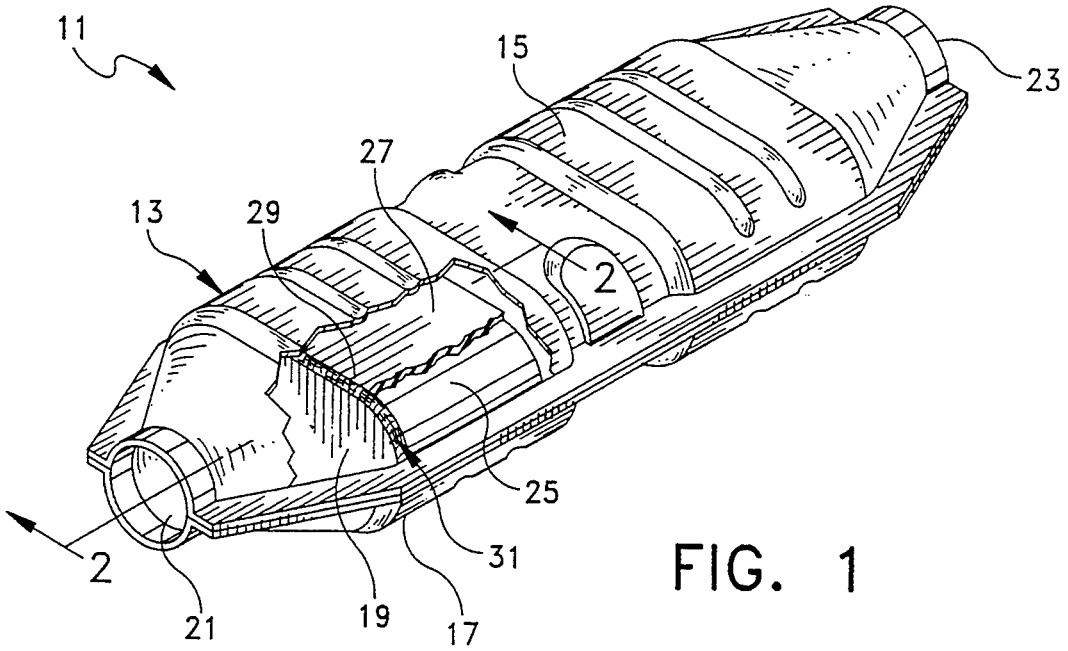
FIG. 1 is a perspective view of a catalytic converter apparatus with portions removed revealing a barrier strip for a catalytic brick support mat of the present invention.
Figure 2:
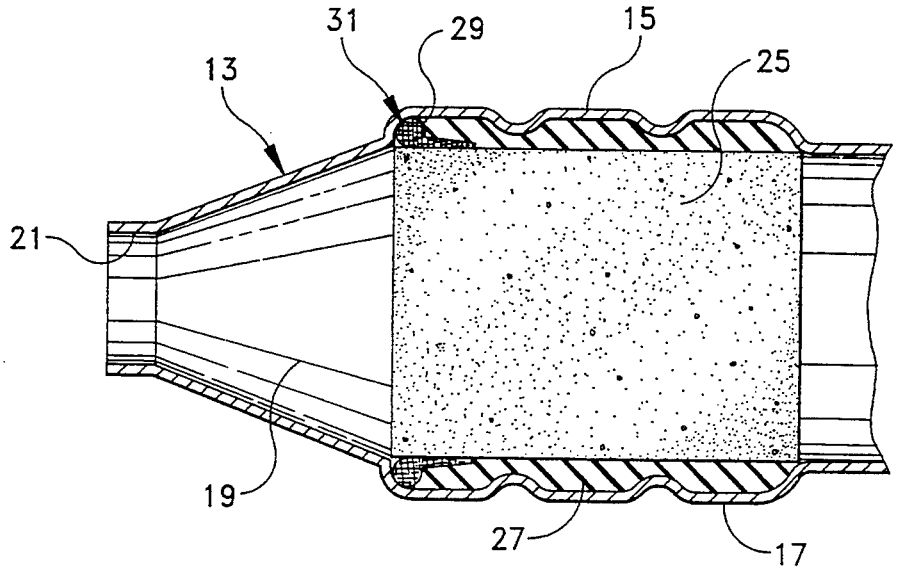
FIG. 2 is a cross-sectional view thereof taken along line 2—2 of FIG. 1.

Referring to the drawings, and more particularly to FIGS. 1 and 2, there is generally indicated at 11 a catalytic converter apparatus for an automobile (not shown). Apparatus 11 includes an elongate housing 13 fabricated from sheet metal material. The housing generally indicated 13 includes top and bottom walls 15, 17 attached together at their peripheries in a suitable manner, e.g., by welding or sheet metal screws. The top and bottom walls 15, 17 define an interior chamber 19. An inlet 21 at one end of the housing 13 allows hot gas produced by an engine (not shown) of the automobile to enter the chamber 19 and an outlet 23 at the other end of the housing exhausts hot gas from the chamber.

Catalytic bricks, each designated 25, are positioned within the chamber 19 for purifying the hot gas entering the chamber. Each brick 25 is secured and positioned in the chamber 19 by a support mat 27 which is disposed within the chamber between the walls 15, 17 of the housing 13 and the brick. Each support mat 27 secures its respective brick 25 within the chamber 19 of the housing 13 and prevents the longitudinal and lateral movement of the brick within the chamber. Support mats 27 are fabricated from intumescent material (i.e., material sold under the tradename "INTERAM" by 3M of Minneapolis, Minn.) and swell when exposed to hot gas so that the space between the walls 15, 17 of the housing 13 and the exterior of the brick 25 is occupied. Each support mat 27 has a leading edge 29 located adjacent the inlet 21 of the housing 13. Without protection, the leading edge 29 of the support mat 27 is subject to excessive wear caused by the flow of hot gas over the leading edge of the support mat. This wear of the support mat 27 may cause it to fail to support the brick 25 in which case would require the replacement of the catalytic converter.

Figure 3:
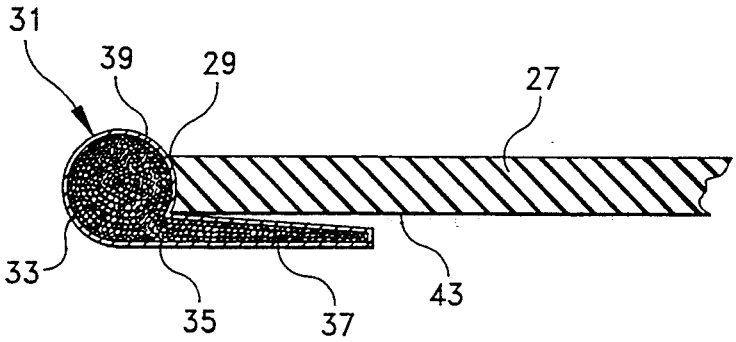
FIG. 3 is a sectional end view of the barrier strip as it is attached to the support mat.
Figure 4:
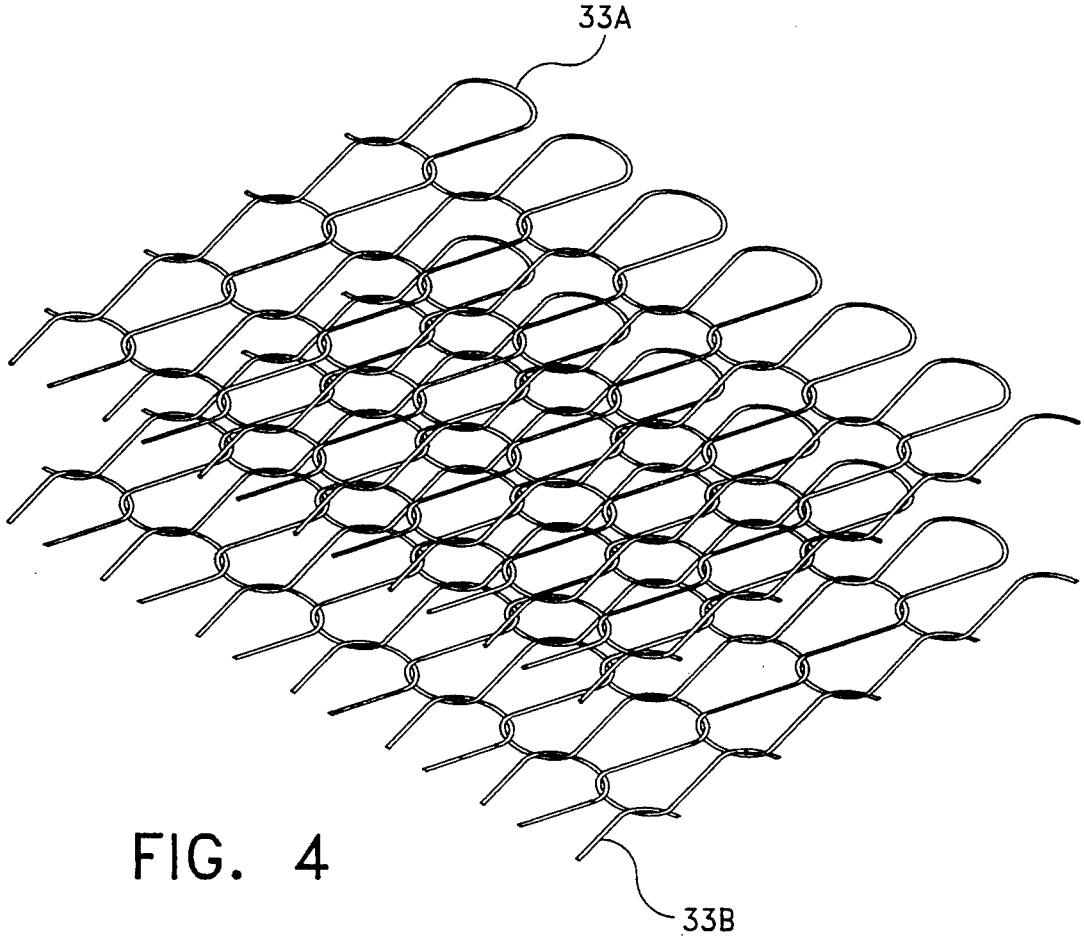
FIG. 4 is a perspective view of first and second layers of woven wires which form a body of the barrier strip.

To protect the leading edge 29 of the support mat 27 from excessive wear, a barrier strip generally designated 31 is attached thereto. Referring to FIG. 3 the barrier strip 31 comprises a body 33 of wire mesh made from heat-resistant material such as SAE 309. It is to be understood that the body 33 of the barrier strip 31 may be made from heat resistant materials other than SAE 309 however, this material was chosen for its performance under compression and in high temperatures. As illustrated in FIG. 4 the wire mesh body 33 of barrier strip 31 comprises a first layer 33A having plurality of woven wires which overlies a second layer 33B of woven wires. The first layer 33A of woven wires includes round wires and the second layer 33B of woven wires are flattened wires. The round wires of the first layer 33A have approximately a 0.0045 inch diameter and the flattened wires of the second layer 33B (which are fabricated from the 0.0045 inch diameter round wires) are flattened to a thickness of approximately 0.001 inch. The body 33 of the barrier strip 31 is enclosed by an outer mesh 35 made from 0.0045 inch diameter wire (FIG. 3).

Figure 5:
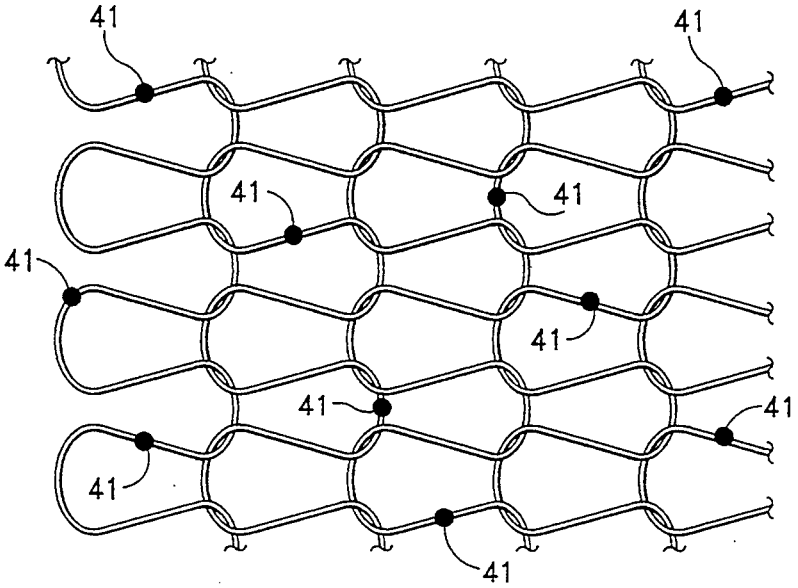
FIG. 5 is an enlarged view of the barrier strip.

The body 33 of the barrier strip 31 is formed by rolling the first and second layers 33A, 33B into concentric tubes (not shown) and applying the outer mesh 35 over the tubes. A calendar machine (not shown) then forms the body 33 and outer mesh 35 to have a relatively flat portion 37 and a rounded portion 39. The flat portion 37 is slightly tapered as illustrated in FIG. 3. After forming the barrier strip 31, it is heat treated at approximately 2000 degrees Fahrenheit for annealing the wire mesh. This heat treating process also forms carbon deposits 41 (FIG. 5) on the wire mesh which act as a leak barrier strip for preventing hot gas from contacting the support mat 27.

Figure 6:
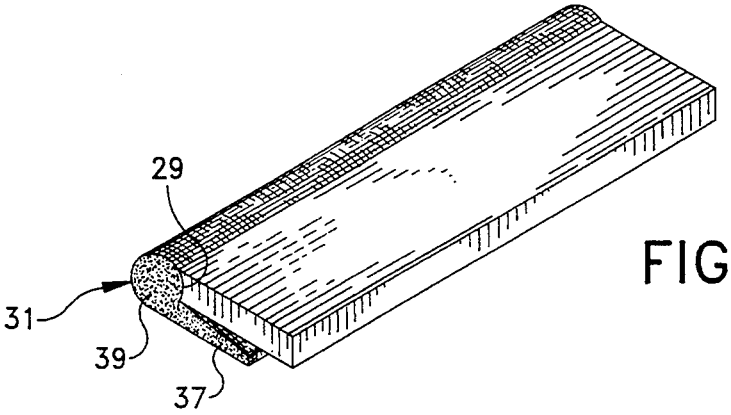
FIG. 6 is a perspective view of the barrier strip and support mat.
Figure 7:
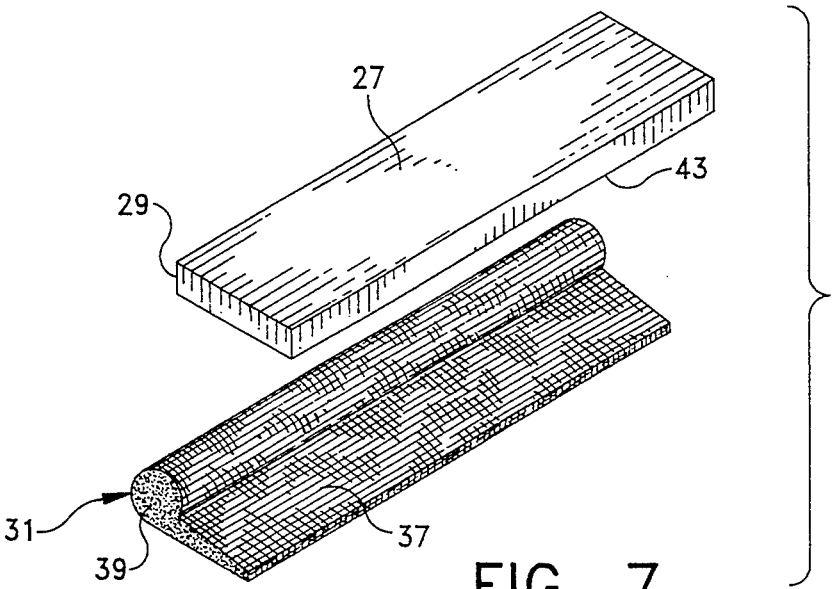
FIG. 7 is an exploded perspective view of the barrier strip and support mat.

As shown in FIGS. 6 and 7, the flat portion 37 of the body 33 of the barrier strip 31 is attached to a bottom edge margin 43 of the support mat 27 by adhesive (not shown) and the rounded portion 39 extends forwardly of the wider end of the tapered flat portion 37 for protecting the leading edge 29 of the support mat. The support mat 27 and barrier strip 31 are then form-fitted in a conventional manner over the brick 25. Each brick 25 is placed on the bottom wall 17 of the housing 13 and is enclosed within the chamber 19 of the housing by attaching the top wall 15 to the bottom wall 17 (e.g., by welding).

In use, hot gas produced by the automobile's engine flows through the inlet 21 and into chamber 19. The hot gas expands the support mat to secure the brick 25 within the chamber. The hot gas melts the adhesive between the barrier strip 31 and support mat 27, however, the barrier strip is held in place by compressive forces generated by the support mat. The taper of the flat portion 37 enables the barrier strip 31 to be tightly secured to the support mat 27 (i.e., in a position so that barrier strip is integral with the support mat). The tapered flat portion 37 also causes the rounded portion 39 to slightly pivot about its connection to the flat portion in a clockwise direction (as viewed in FIG. 2) for protecting the leading edge 29 of the support mat. Thus, as illustrated, the barrier strip 31 prevents hot gas from contacting the leading edge of the support mat 27 and from entering the space between the .support mat and the housing 13 thereby protecting the support mat 27 against excessive wear of its leading edge 29.

It is envisioned that the barrier strip 31 may be used in other applications where it is necessary to protect the leading edge of fabric material from excessive wear caused by hot gas flowing over the material.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a catalytic converter apparatus comprising a housing having a chamber, an inlet for receiving gas, and an outlet for exhausting gas, a catalytic brick positioned within the chamber for purifying gas entering said chamber via the inlet, and a support mat disposed between the housing and the catalytic brick for supporting the catalytic brick with respect to the housing, said support mat having a leading edge located adjacent said inlet of the housing, the improvement comprising a barrier strip attached to said leading edge of the support mat for protecting said leading edge from excessive wear resulting from the flow of gas over the leading edge of the mat, said barrier strip being fabricated from wire mesh material and comprising a tapered portion which is attached to a bottom edge margin of the support mat and a generally rounded portion extending forwardly of a wider end of the tapered portion which protects said leading edge of the support mat, said tapered portion causing the rounded portion to slightly pivot about its connection to the tapered portion when compressed by the support mat so that it compresses against the leading edge of the support mat for protecting the leading edge of the support mat.

2. The apparatus as set forth in claim 1 wherein said barrier strip comprises heat-resistant material.

3. The apparatus as set forth in claim 1 wherein said barrier strip comprises wire mesh.

4. The apparatus as set forth in claim 3 wherein said wire mesh comprises a first layer having a plurality of woven wires and a second layer having a plurality of woven wires.

5. The apparatus as set forth in claim 4 wherein said first layer comprises round wires and said second layers comprises flattened wires.

6. The apparatus as set forth in claim 3 wherein said wire mesh includes carbon deposits which substantially prevent said hot gas from contacting the support mat.

7. The apparatus as set forth in claim 1 wherein said barrier strip comprises wire mesh.

8. The apparatus as set forth in claim 1 wherein said flat portion of the barrier strip is integral with the support mat.

* * * * *